United States Patent [19]

Le Bras

[11] Patent Number: 4,530,198

[45] Date of Patent: Jul. 23, 1985

[54] APPLICATOR MECHANISM AND METHOD FOR FITTING SLEEVES ONTO ARTICLES

[75] Inventor: Philippe Le Bras, Chateauroux, France

[73] Assignee: The Mead Corporation, Dayton, Ohio

[21] Appl. No.: 520,355

[22] Filed: Aug. 4, 1983

[30] Foreign Application Priority Data

Sep. 1, 1982 [GB] United Kingdom ..... 8224932

[51] Int. Cl.[3] ..... B65B 21/14

[52] U.S. Cl. ..... 53/48; 53/398; 53/585

[58] Field of Search ..... 53/48, 398, 585, 295, 53/292

[56] References Cited

U.S. PATENT DOCUMENTS 3,404,505 10/1968 Hohl ..... 53/398
3,627,193 12/1971 Helms ..... 53/398 X
3,698,151 10/1972 Arneson ..... 53/398
3,848,519 11/1974 Ganz ..... 53/48 X
3,940,907 3/1976 Ganz ..... 53/48
4,357,788 11/1982 Amberg ..... 53/585

*Primary Examiner*—John Sipos
*Attorney, Agent, or Firm*—Erwin Doerr

[57] ABSTRACT

Applicator mechanism for fitting a sleeve (10) to at least one moving bottle (B) comprises supply means (44) holding collapsed sleeves, erecting means (WD) sequentially to bring each sleeve into a set-up condition, transfer means (96–104) to effect downward transfer of the set-up sleeve towards said article to be sleeved and applicator means (106–112) for fitting the sleeve around the article. The applicator means is operable to execute both a downward and forward motion to the sleeve such that the forward motion of the sleeve substantially is synchronized with that of the article during fitment of the sleeve thereto.

3 Claims, 7 Drawing Figures

48
48b
98
48a
72
92
74
14
104
76
108
X
10°
X
12
112
10
B
B
80

APPLICATOR MECHANISM AND METHOD FOR FITTING SLEEVES ONTO ARTICLES

This invention relates to an applicator mechanism for fitting an end closure sleeve onto one or more articles in a multiple packaging process. The applicator mechanism is particularly useful for fitting a sleeve onto a pair of bottles at each end of a group of bottles which then has an open-ended wrapper applied thereto which holds together the bottle group to form a multiple unit package. The wrapper has its opposite ends closed by the fitted sleeves thereby forming a totally enclosed package which is suitable for protecting bottled beverages whose organoleptic properties can be affected by ultraviolet light. Such a package is disclosed in our U.S. patent application Ser. No. 403,111 filed July 29, 1982 entitled "Article Carrier", abandoned in favor of Ser. No. 592,745 filed Mar. 23, 1984 now U.S. Pat. No. 4,498,582.

One aspect of the invention provides a mechanism for applying a sleeve to at least one moving article so that the article is introduced through an open base of the sleeve, which apparatus comprises supply means for accommodating a plurality of said sleeves in collapsed condition, erecting means to bring each sleeve sequentially into a set-up condition and present the set-up sleeve for downward transfer towards the article to be sleeved, transfer means to effect said downward transfer and applicator means for fitting said transferred sleeve around said article, said applicator means being operable to execute both a downward and a forward motion to the sleeve such that the forward motion of the sleeve is substantially synchronized with that of the article, conveyed beneath the mechanism, during fitment of the sleeve onto said article.

Another aspect of the invention provides a method of applying a sleeve to at least one moving article so that the article is introduced through an open base of the sleeve, which method comprises withdrawing a collapsed sleeve from a supply and bringing the sleeve into a set-up condition, transferring the set-up sleeve towards the article to be sleeved, executing a downward and forward motion to the sleeve to complete the transfer step so that the sleeve is fitted around said moving article and such that the forward motion of the sleeve substantially is synchronized with that of the article during fitment of the sleeve thereto.

Figure 1:
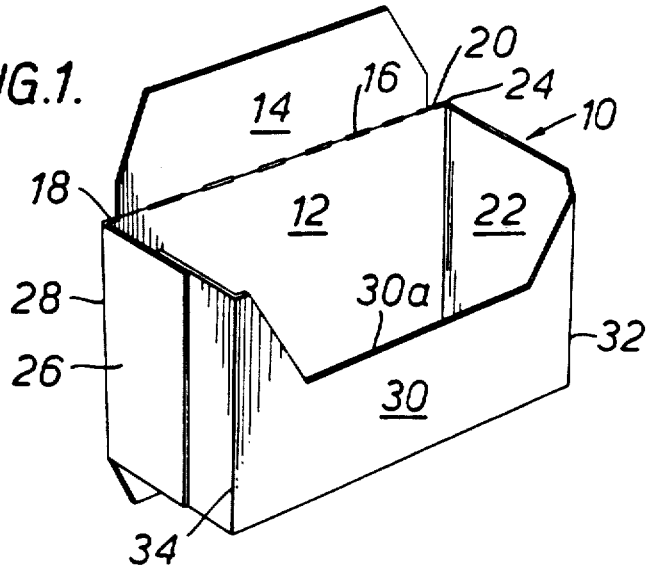
Figure 2:
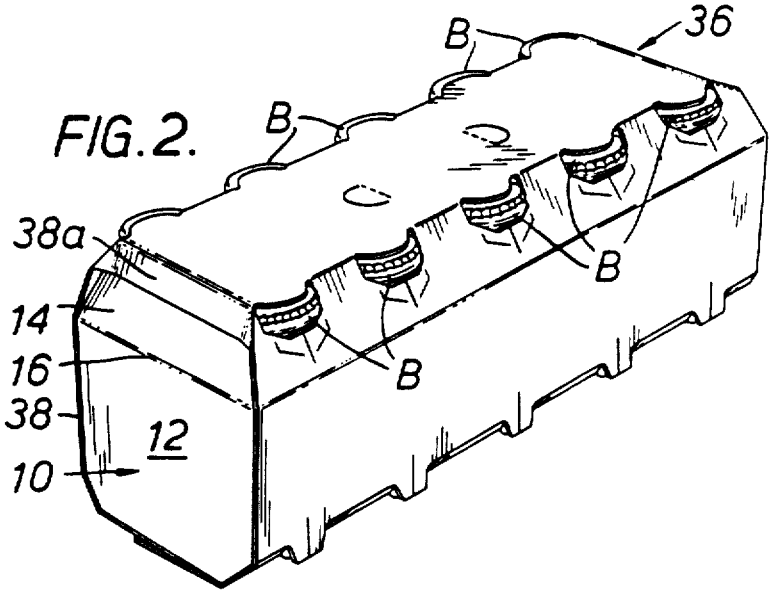
Figure 3:
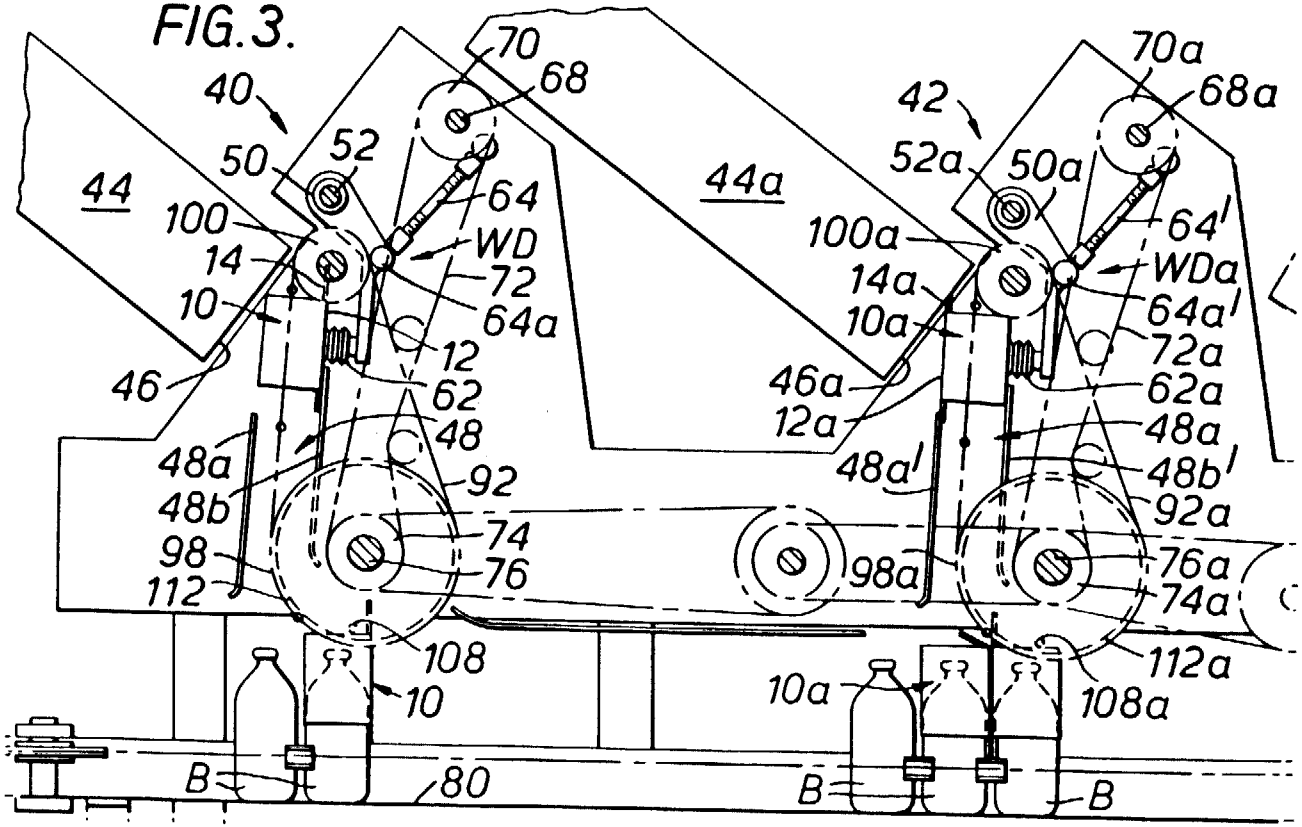
Figure 4:
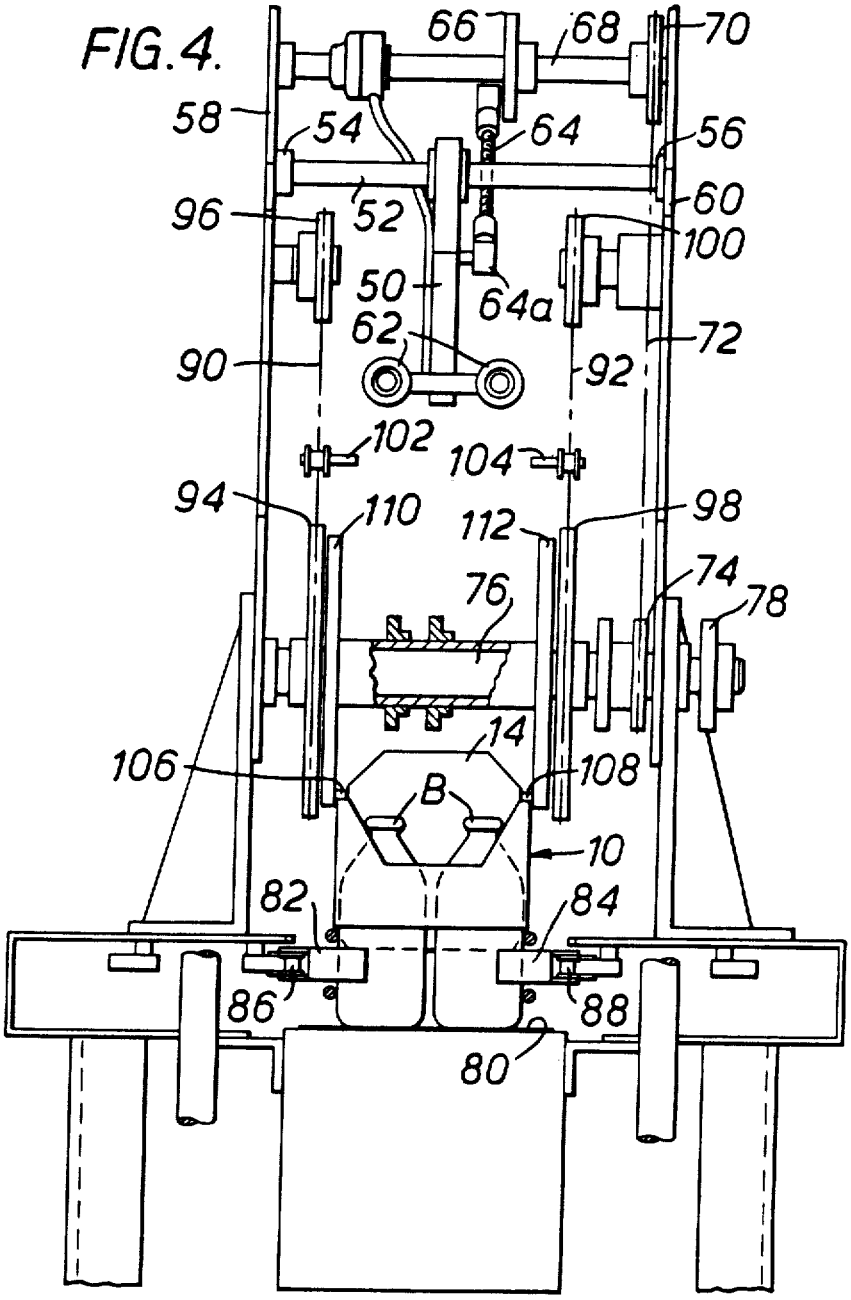
Figure 5:
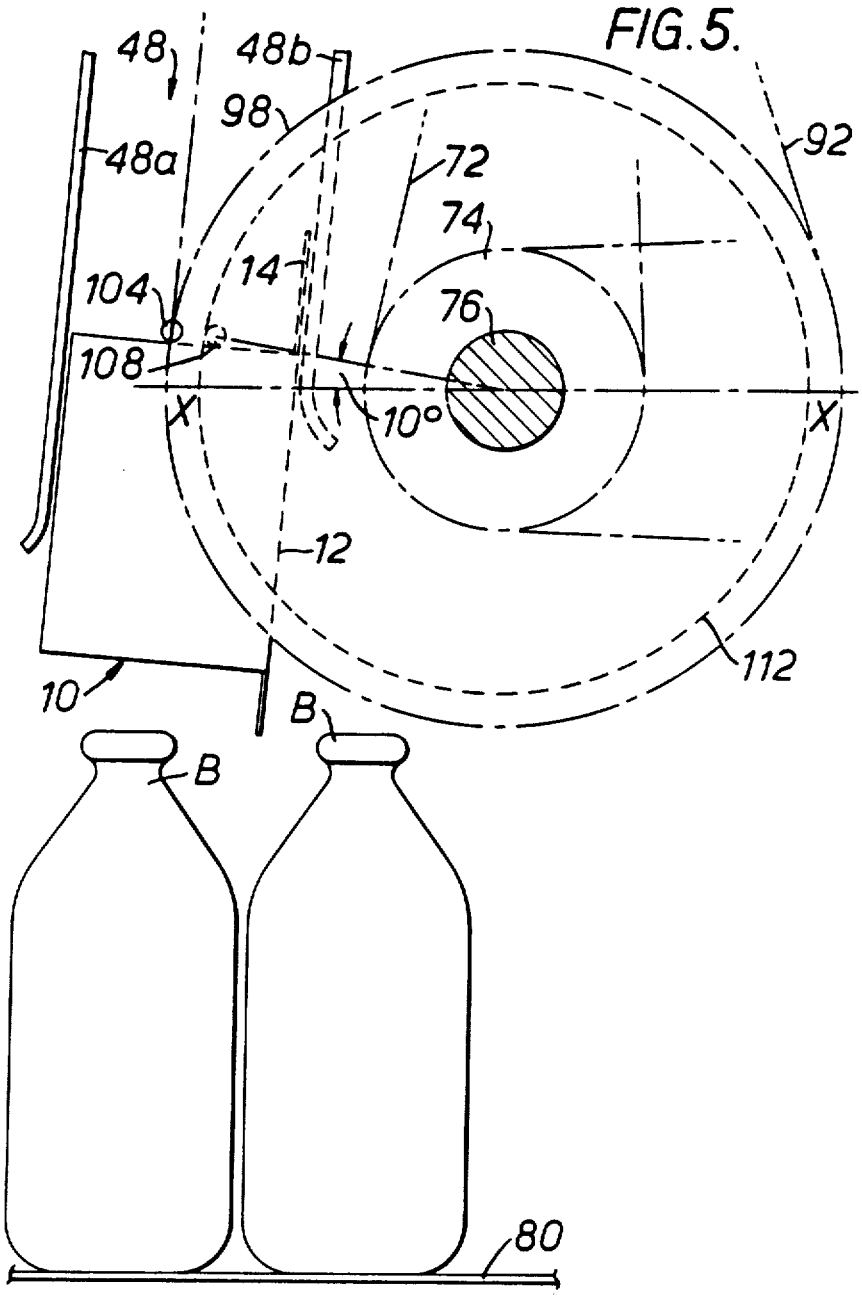
Figure 6:
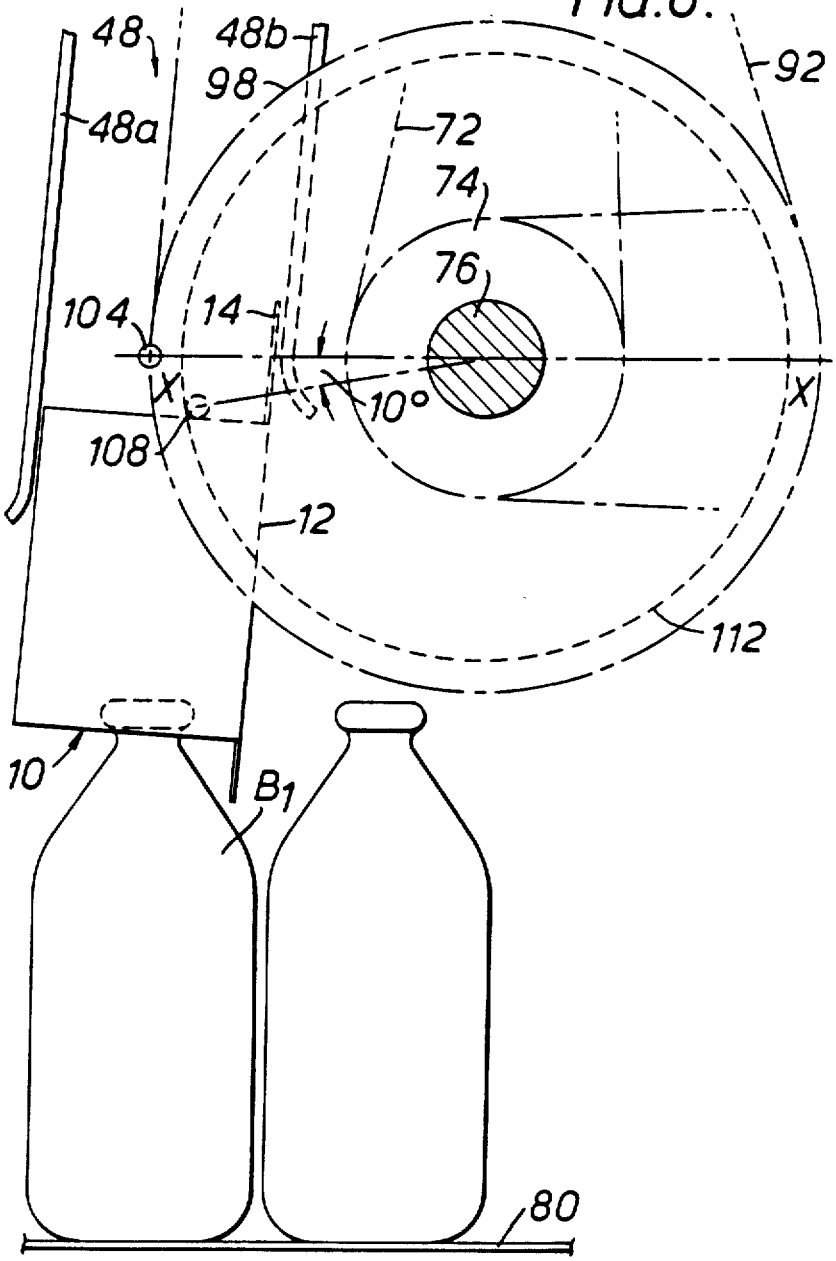
Figure 7:
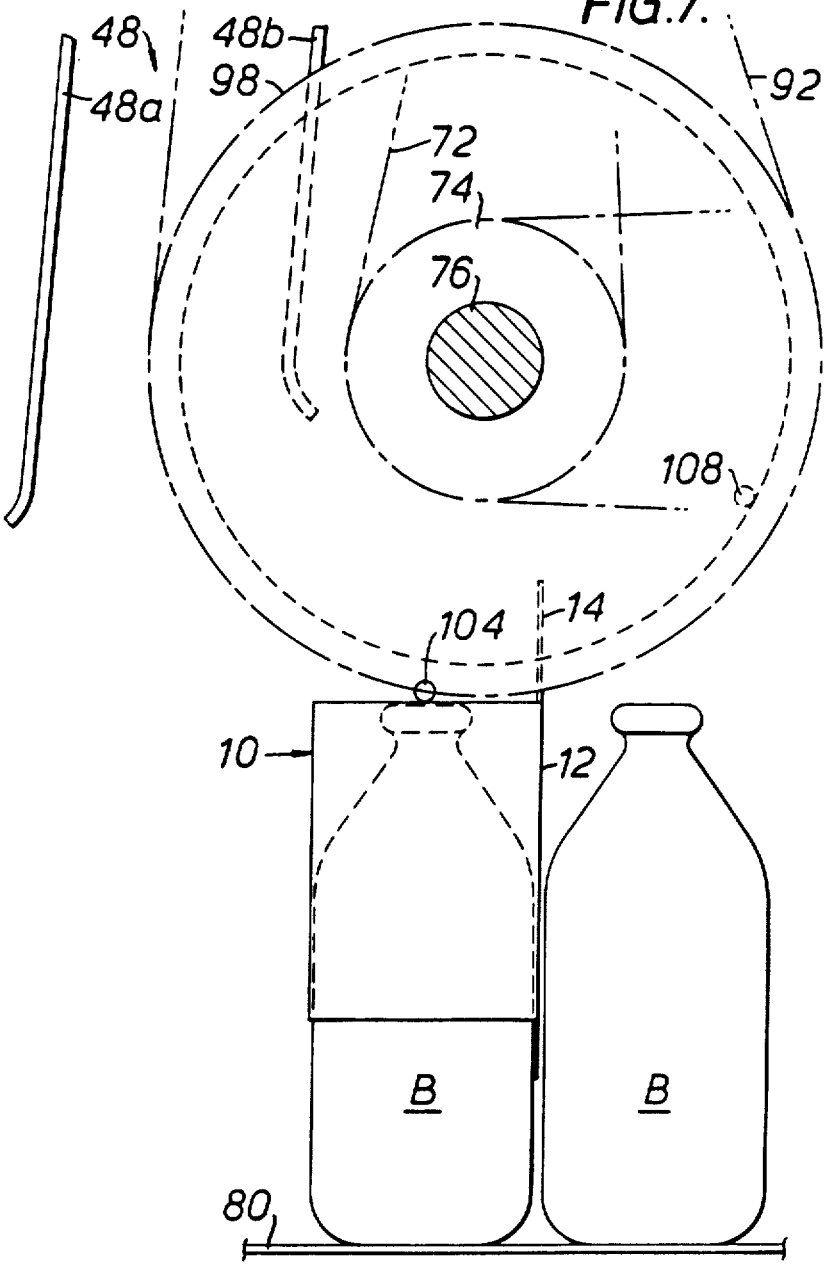

An embodiment of the invention will now be described, by way of example, with reference to the accompanying drawings, in which:

FIG. 1 is a perspective view of a closure sleeve suitable for use in the mechanism according to the invention, FIG. 2 is a perspective view of a completed package incorporating a closure sleeve at each of its ends, FIG. 3 is a schematic side view of the applicator mechanism according to the invention, FIG. 4 is a schematic end view of the applicator mechanism according to the invention, and FIGS. 5 to 7 are schematic views illustrating fitment of a sleeve around a pair of bottles.

Referring first to FIG. 1, there is shown a closure sleeve 10 suitable for use with the mechanism according to the invention. The sleeve 10 comprises a main panel 12 to the top edge of which an auxiliary panel 14 is hinged along fold line 16. Auxiliary panel 14 is cut away at each end and the fold line 16 stops short of each top end edge of the main panel leaving exposed shoulder portions 18, 20, respectively. Side panel 22 is hinged to one side edge of the main panel along fold line 24 and, similarly, composite side panel 26 is hinged to the opposite side edge of the main panel along fold line 28. A back panel 30 is hinged to each of the side panels along fold lines 32, 34 respectively and a nesting notch **30*a* is formed in the upper edge of the back panel. Thus, economy of material is achieved since the closure sleeve can be nested with an adjacent closure sleeve by means of cooperation between auxiliary panel 14 of one blank and nesting notch 30*a*** of an adjoining blank.

A completed package 36 is shown in FIG. 2 in which a group of bottles 'B' are accommodated within an open-ended wrapper 38 having end closure sleeves 10 at each end thereof. Each end closure sleeve encloses an endmost pair of bottles within the package and the auxiliary panel 14 is folded inwardly of the package along fold line 16. End panel **38*a* of the wrapper is folded downwardly in overlapping face contacting relationship with the outer face of the adjacent auxiliary panel 14**.

An applicator mechanism for applying a closure sleeve, such as that shown in FIG. 1, to a pair of bottles is illustrated in FIGS. 3 and 4.

Referring to FIG. 3, the applicator mechanism comprises two similar units 40, 42 respectively, mounted in tandem on a packaging machine. The applicator units are both mounted upstream of that part of the machine which applies wrappers, such as wrapper 36 shown in FIG. 2, to a group of bottles.

Applicator mechanism 40 comprises a hopper 44 in which a supply of closure sleeves 10 are held each with its main and auxiliary panels 12, 14 respectively, facing the open mouth 46 of the hopper. The hopper is mounted in an inclined attitude above a sleeve guide 48 comprising guide plates **48*a*, 48*b* such that the hopper mouth 46 is disposed adjacent the path of movement of a sleeve withdrawal device 'WD'. The withdrawal device comprises an oscillatory arm 50 fixedly mounted on a rotary shaft 52 which is journalled at each of its ends in bearings 54 and 56, mounted on vertical face plates 58 and 60, respectively, of the mechanism 40. The arm 50 carries at its free end a pair of vacuum cups 62 for engagement with the main panel of the leading sleeve within the hopper 44. A connecting linkage 64 is pivotally mounted at 64*a* to the arm 50 intermediate its ends and to a sprocket 66 carried by rotatable shaft 68 mounted parallel to and above shaft 52. Shaft 68 carries a driven sprocket 70 which is rotated through chain drive 72 and sprocket 74 mounted on shaft 76. Shaft 76 also is journalled in bearings carried by the vertical face plates 58 and 60 and is mounted parallel to and below rotary shaft 52 to be driven from sprocket 78 connected by suitable gearing to the main drive source of the machine. When shaft 76 is rotated drive is transmitted to rotary shaft 68 which causes the oscillatory arm to pivot through a predetermined arc by virtue of the connecting linkage 64 so that its vacuum cups 62 oscillate towards and away from the mouth 46** of the supply hopper.

When the vacuum cups 62 are in abutment with the main panel 12 of the leading sleeve 10 present at the mouth of the hopper, vacuum is applied so that the sleeve is engaged and as the oscillatory arm 50 is pivoted away from the hopper mouth, the sleeve 10 is brought into a set up condition as shown in FIG. 3 above sleeve guide 48. In this position the main panel 12 of the sleeve 10 is held adjacent the forward guide plate 48*b*. Suction is then released so that the vacuum cups 62 are detached from the sleeve 10 whereafter the sleeve may be transferred downwardly through the sleeve guide 48 for fitment over a pair of bottles 'B'.

A series of bottles 'B' are conveyed in pairs along conveyor base 80 by means of side lugs 82 and 84 carried by side lug chains 86 and 88 respectively. The side lug chains are driven by suitable drive means and the arrangement is such that bottle conveying and sleeve transfer are synchronized so that bottles are present when a sleeve reaches the lower end of the guide 48.

Transfer is effected by means of a pair of spaced vertical transfer chains 90, 92 which are entrained about sprockets 94, 96 and 98, 100 respectively. Sprockets 96 and 100 are journalled in the vertical face plates 58 and 60 adjacent either side of the oscillatory arm 50 and sprockets 94 and 98 are carried by the rotatable shaft 76. Each of the transfer chains 90 and 92 carry a series of spaced inwardly directed lugs 102, 104, respectively for engagement with sleeve 10 to effect transfer thereof through the sleeve guide 48.

The lugs 102, 104 engage the upper edge of each of the side panels 22, 26 respectively of the sleeve 10 and push the sleeve downwardly through the guide 48 towards a pair of bottles present on conveyor base 80 adjacent the lower end of guide 48 and on which the sleeve is to be fitted. As the open base of the sleeve approaches the tops of the bottles cam elements 106, 108 carried by rotatable cam discs 110, 112 respectively pass through the shoulder portions 18 and 20 of the sleeve and wipe across the top edge of side panels 22 and 26. The cam discs 110 and 112 which are mounted on rotatable shaft 76 inwardly of sprockets 94 and 98 are of smaller diameter than the sprockets 94, 98, respectively, and therefore the cam elements 106 and 108 wipe across the top edges of the side panels through a pre-determined angle of arc at a greater speed than the angular speed of rotation of the lugs 102, 104 passing around their respective sprockets 110 and 112. This action by the cam elements accelerates the sleeve forwardly whilst simultaneously continuing to exert a downward pressure on the sleeve to seat the sleeve on the bottles. The momentary acceleration is required in that the sleeve movement is altered from a substantially vertical transfer to a horizontal motion necessary to match the linear speed of the bottles to which the sleeve is fitted. The action is more particularly described with reference to FIGS. 5 to 7.

FIGS. 5 to 7, schematically illustrate the cooperation between the transfer lugs and the cam elements during seating of a sleeve onto a pair of bottles. Reference is made to transfer lugs 104 and cam element 108 carried by cam disc 112 acting on one side of sleeve 10, it being understood that the opposed components comprising transfer lugs 102 and cam element 106 carried by cam disc 110 act on the other side of the sleeve in like manner.

When sleeve 10 has moved through the sleeve guide 48 to the position shown in FIG. 5, in which the open lower end of the sleeve is disposed immediately above the bottle pair 'B', downward pressure is being exerted by transfer lug 104 on the top edge of one side wall of the sleeve. At this time, cam element 108, carried by cam disc 112, also engages the top edge of the side wall. The cam element 108 is then at a position approximately 10° above the diametric datum line 'X—X'. Transfer of the sleeve then continues with force applied for a predetermined period simultaneously by both the lug 104 and cam element 108. When the sleeve has been moved downwardly to the position shown in FIG. 6, downward force is continued solely by the cam element 108. This occurs since the arcuate speed of cam element 108 is greater than that of lug 104 passing around sprocket 98. At this time cam element 108 is approximately 10° diametric line 'X—X'.

As the cam element continues along its arcuate path the sleeve is forced downwardly and forwardly during fitment onto the bottle pair '$B_1$'. The cam element 108 continues its arcuate movement wiping across the top edge of the side wall of the sleeve so as to execute a forward accelerating force on the sleeve to bring the forward speed of the sleeve into synchronism with that of the bottle pair to which it is applied.

In FIG. 7 the cam element has completed execution of the wiping operation whereby the sleeve is seated on the bottle pair 'B'. Once the sleeve is seated, lug 104 passes over the top edge of the sleeve behind the cam element to continue on its return run towards sprocket 100.

The sleeved bottles then proceed along conveyor base 80 to a wrapping station of the machine (not shown).

The applicator unit 42 is similar in construction to unit 40 and like reference numerals designate like parts with the addition of suffix 'a'. However, in unit 42 the sleeves 10 are accommodated within hopper 42*a* such that the main panel and auxiliary panel 12, 14 respectively of the sleeve is located adjacent the guide plate 48*a*' so that the back panel 30 of the sleeve is located adjacent the mouth of the hopper. This arrangement is required since it is required to fit one sleeve at each end of a package so that both sleeves of the package have their main panels facing outwardly. The arrangement and timing of operation of unit 42 is such that the bottles sleeved by unit 40 pass beneath unit 42 together with a preselected number of unsleeved bottle pairs until the required pair of bottles to be sleeved by unit 42 is positioned for sleeving. Thus, the bottles sleeved by unit 40 form one end of the package whilst the bottles sleeved by unit 42 form the other end of the package.

It is not an essential feature of this invention that the bottles, or other articles, to be sleeved are moving at the time of fitment of the sleeve. It is envisaged, for example, that the sleeve application may be a cyclic process rather than a continuous flow process.

I claim:

1. Mechanism for applying a sleeve (10) downwardly to at least one moving article (B) so that the article is introduced through an open base of the sleeve, which apparatus comprises means to continuously move said articles, supply means (44) above said article moving means for accomodating a plurality of said sleeves in collapsed condition, erecting means (WD) to bring each sleeve sequentially into a set-up condition and present the set-up sleeve for downward transfer towards the article to be sleeved, transfer means (96–104) to transfer said sleeve downwardly and applicator means (106–112) for fitting said transferred sleeve around said article, said applicator means being operable to execute both a downward and a forward motion to the sleeve such that the forward motion of the sleeve is substantially synchronised with that of the article conveyed beneath the mechanism during fitment of the sleeve onto said article, said transfer means comprising a pair of endless belts (90,92) spaced apart to receive a sleeve therebetween and having a series of inwardly directed lugs (102,104) for engaging the upper edge of said sleeve and pushing said sleeve downwardly, and a sleeve guide (48) including guide plates (**48*a*,48*b*) through which a set-up sleeve is driven by said lugs, said applicator means comprising cam elements (106,108) carried by rotatable cam discs (110,112**), means to rotate said cam disk so that said cam elements move through an arcuate path and wipe across the upper edge of said sleeve to apply a downward and forward pushing force to a transferred sleeve.

2. Mechanism according to claim 1, wherein said cam discs are mounted coaxially and inwardly of a pair of sprockets (94,98) about which said endless belts are entrained.

3. Mechanism according to claim 2, wherein said cam discs are driven at a higher speed so that the cam elements wipe across upper side faces of a sleeve through a predetermined angle of arc at a greater speed than that of said lugs passing around their respective sockets thereby to accelerate the sleeve forwardly.

* * * * *